US007510433B2

(12) United States Patent
Blakborn et al.

(10) Patent No.: US 7,510,433 B2
(45) Date of Patent: Mar. 31, 2009

(54) COAXIAL PLUG CONNECTOR FOR A COAXIAL CABLE

(75) Inventors: Willem Blakborn, Inzell (DE); Markus Schichl, Wallersee (AT); Helmut Muhlfellner, Laufen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 11/693,008

(22) Filed: Mar. 29, 2007

(65) Prior Publication Data

US 2007/0202739 A1 Aug. 30, 2007
US 2009/0042441 A9 Feb. 12, 2009

Related U.S. Application Data

(63) Continuation of application No. PCT/EP2005/010477, filed on Sep. 28, 2005.

(30) Foreign Application Priority Data

Oct. 4, 2004 (DE) ..... 20 2004 015 365 U

(51) Int. Cl.
*H01R 9/05* (2006.01)

(52) U.S. Cl. ..... 439/578; 439/272

(58) Field of Classification Search ..... 439/271, 439/272, 273, 274, 578, 580, 583, 584
See application file for complete search history.

(56) References Cited

U.S. PATENT DOCUMENTS 5,662,495 A 9/1997 Inaba et al.

FOREIGN PATENT DOCUMENTS

| | | |
|---|---|---|
| DE | 39 27 639 A1 | 3/1991 |
| DE | 44 32 878 A1 | 3/1996 |
| EP | 1 345 290 A | 9/2003 |

*Primary Examiner*—Khiem Nguyen
(74) *Attorney, Agent, or Firm*—DeLio & Peterson, LLC; Robert Cürcio

(57) ABSTRACT

A coaxial plug connector having a housing produced from an electrically insulating material, which is open at a plug end so that a mating coaxial plug connector can be inserted. An insertion area for the mating housing is provided. At a coaxial cable end, the housing has an axial opening for coaxial cable insertion. Inside the housing, an internal and external conductor elements for electrically connecting internal and external conductors of the coaxial cable, respectively, are provided. A snap-in mechanism is configured on the housing to fix the external conductor element in the housing in at least the axial direction. A sealing sleeve completely surrounds the external conductor element in the circumferential direction, and in the axial direction in at least an area that extends from a part of the housing at the coaxial cable end to the insertion area for the mating housing at the plug end.

16 Claims, 2 Drawing Sheets

COAXIAL PLUG CONNECTOR FOR A COAXIAL CABLE

Figure 1:
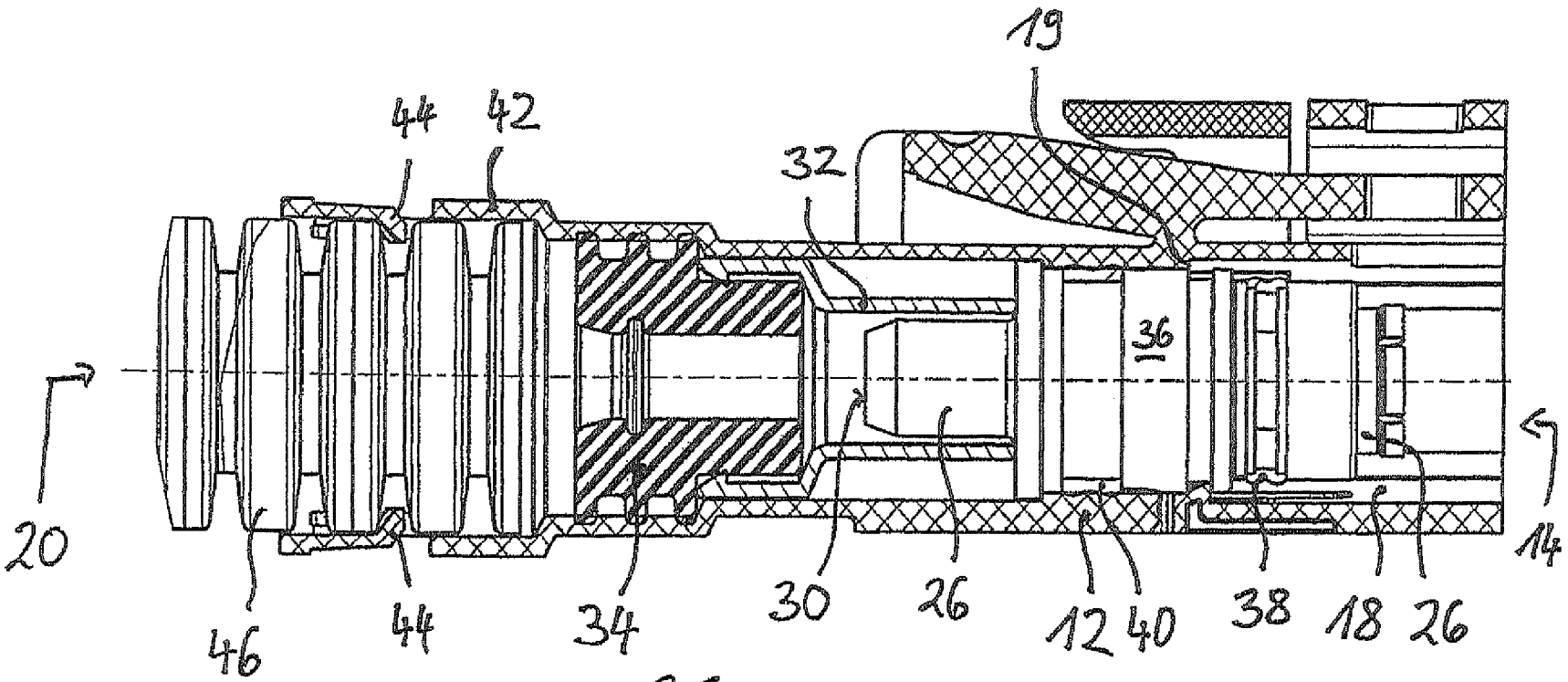

This application is a continuation of PCT Application No. PCT/EP2005/010477 filed Sep. 28, 2005, and claims priority from German Application No. DE20 2004 015 365.3 filed Oct. 4, 2004.

The present invention concerns a coaxial plug connector for a coaxial cable with a housing made of an electrically insulating material, which at a plug end is open for the insertion of a mating coaxial plug connector with a mating housing and exhibits a plugging region for the mating housing into which the mating housing projects in the inserted state, and at a coaxial cable end exhibits an axial opening for the insertion of the coaxial cable, where in the housing there is arranged an internal conductor element for electrically connecting with an internal conductor of the coaxial cable and an external conductor element for electrically connecting with an external conductor of the coaxial cable and where at the housing there is arranged and configured a snap-in mechanism in such a way that it fixes the external conductor element in the housing at least in the axial direction, in accordance with the preamble of claim 1.

A coaxial plug connector for a high-voltage coaxial cable is known from DE 44 32 878 A1, where at a front face of a housing there is arranged an axial sealing ring. In a hollowing of a mating socket there is provided a radial sealing ring that comes into contact with a cylindrical mating face of the housing. Additionally, a further axial sealing ring is provided at a front face in the mating socket, which engages with the free front face at the end of the housing. In addition to electric contact, these three seals also ensure reliable sealing against fluids and gases.

A coaxial plug connector with a synthetic housing is known from US 2003/0176104 A1, which corresponds to the scheme known as the FAKRA standardization scheme (FAKRA=Fachkreis Automobiltechnik=Vehicle Engineering Technical Group) for SMB connections. The synthetic housing provided here holds the plug connector, protects it and pre-positions it for the plugging procedure with another plug connector with a synthetic housing. The housing additionally exhibits mechanical codings, so that only matching housings can be plugged into each other.

The invention is based on the task of improving a coaxial plug connector for a coaxial cable of the aforementioned type with regard to functional reliability and possible and/or permissible application environments and/or environmental conditions.

This task is solved by the invention by means of a coaxial plug connector of the aforementioned type with the features identified in claim 1. Advantageous embodiments of the invention are described in the following claims.

In a coaxial plug connector of the aforementioned type, the invention provides that a sealing sleeve completely surround the external conductor element in the circumferential direction, and in the axial direction at least in a region that extends from a part of the housing that is enclosed on all sides in the radial direction at the coaxial cable end of the housing, to the insertion region for the mating plug at the plug end of the housing.

This has the advantage that the coaxial plug connector is sealed within the housing against the ingress of fluids, where this sealing is independent of any radial breakthroughs in the housing, e.g., in the region of the snap-in mechanism. This achieves complete sealing without modifications to the housing, so that for a standard-compliant housing, such as, e.g., housings conforming to the FAKRA standardization scheme, complete sealing of the region of the coaxial plug connection can be produced. This makes the use of such coaxial plug connectors possible even under special environmental conditions, such as, e.g., wet environments or environments with corroding fluids, in particular inside the engine compartment of a motor vehicle, without the functionality of the coaxial plug connection being impaired by the special environmental conditions, for example through a short circuit, corrosion or dirt.

Additional sealing of the coaxial plug connector between the external conductor element and the mating housing in the plug region is achieved by having the plug region bounded in the direction of the coaxial cable end of the housing by a ring-shaped front face of the housing, where at the outer circumference of the sealing sleeve there is arranged a first O-ring seal which in the axial direction between the ring-shaped front face of the housing and the plug end of the housing in the insertion region is arranged and configured in such a way, that the first O-ring seal projects into a ring-shaped region within the housing, which in the housing is recessed for insertion of a section of the mating housing. Thereby, the first O-ring seal in the mating housing plugged into the housing lies against an interior side of the mating housing.

Additional sealing of the coaxial plug connector between the external conductor element and the housing is achieved by having a second O-ring seal arranged at the outer circumference of the sealing sleeve, which in the axial direction between the coaxial cable end of the housing and the insertion region is arranged and configured in such a way that the second O-ring seal lies radially against an inner circumference of the housing.

Additional sealing of the coaxial plug connector between the coaxial cable and the coaxial cable end of the housing is achieved by having a ring seal arranged at the coaxial cable end of the housing with an axial opening for the coaxial cable, lying in the radial direction against an inner side of the housing. Usefully here, the inner diameter of the axial opening of the ring seal is smaller than the outer diameter of the coaxial cable.

In a preferred embodiment of the invention there is provided a crimping sleeve which is crimped on at a coaxial cable end of the external conductor element together with an external conductor of the coaxial cable. The crimping sleeve is for example crimped at its coaxial cable end onto a plug end of the ring seal.

Latching for a corrugated tube pushed over the coaxial cable is achieved by having arranged, at the coaxial cable end of the housing, an axial extension, in particular one configured as a single piece with the housing, with at least one resilient snap-in tongue facing radially inward.

Figure 2:
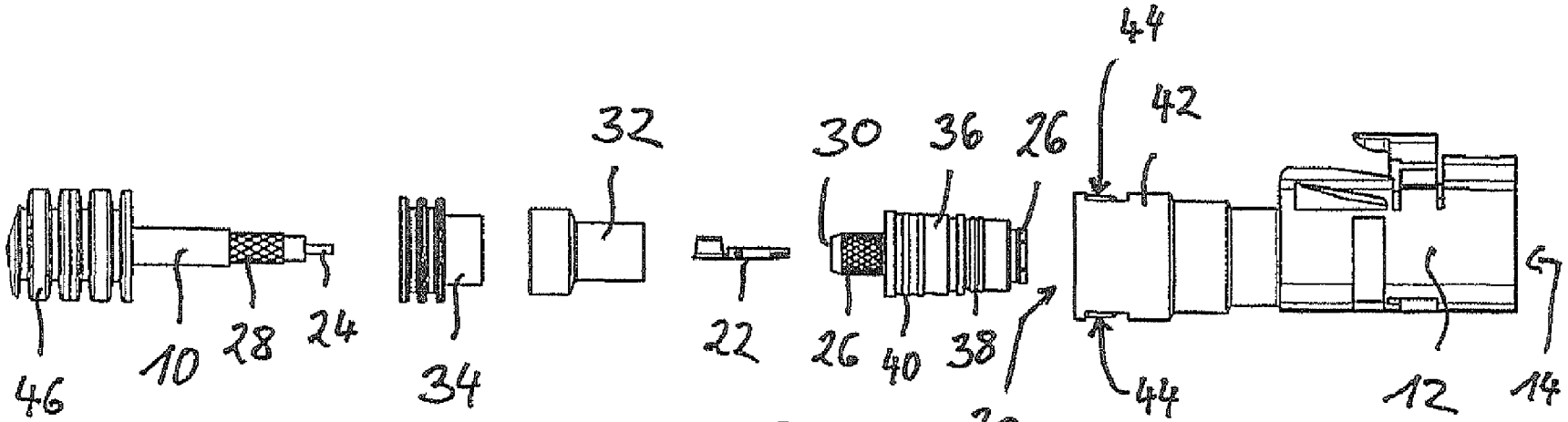

The invention is explained below by reference to the diagram:

FIG. 1 shows a preferred embodiment of the invention's coaxial plug connector in cross-section; and FIG. 2 shows the invention's coaxial plug connector as per FIG. 1 in exploded view.

The preferred embodiment of the invention's coaxial plug connector for a coaxial cable 10, as shown in FIG. 1 and 2, includes a housing 12 made of an electrically insulating material, which at a plug end 14 is open for the insertion of a mating coaxial plug connector with a mating housing. In housing 12 there is configured an insertion region 18 for the mating housing, into which the mating housing projects in the inserted state. In the direction of the coaxial cable end 20 of the housing 12 this insertion region 18 is bounded at an inner side of the housing 12 by a ring-shaped front face 19. At the coaxial cable end 20 the housing 12 exhibits an axial opening for inserting the coaxial cable 10. In the housing 12 there is arranged an internal conductor element 22 for electrical connection with an internal conductor 24 of the coaxial cable and an external conductor element 26 for electrical connection with an external conductor 28 of the coaxial cable 10. At the housing 12 there is arranged and configured a snap-in mechanism (not shown) in such a way that it fastens the external conductor element 26 in the housing 12 at least in the axial direction.

The external conductor element 26 is configured at its end that faces the coaxial cable end 20 of the housing 12 with a tube-shaped section 30 with a reduced diameter. Onto this tube-shaped section 30 there is crimped a crimping sleeve 32 with the external conductor of the coaxial cable 10 lying in-between. This achieves electrical contact and mechanical contact (tension relief) between the external conductor 28 of the coaxial cable 10 and the external conductor element 26.

At the coaxial cable end 20 of the housing 12 there is arranged a ring seal 34 that provides sealing between the coaxial cable 10 and the housing 12.

The invention provides for a sealing sleeve 36 which surrounds a predetermined a region of the external conductor element 26. The surface of this predetermined region is completely enclosed in the circumferential direction and extends in the axial direction from a part of the housing 12 at the coaxial cable end 20 of the housing 12 which is enclosed on all sides to the insertion region 18 for the mating housing at the plug end 14 of the housing 12. Thus the sealing sleeve 36 covers a region in which the snap-in mechanism is located, i.e. a region in which there are present breakthroughs in the housing 12 that connect the environment of the coaxial plug connector with the interior space of the housing 12 and are fluid-conducting. Additionally there are provided on the sealing sleeve 36 a plug end first O-ring seal 38 and a coaxial cable end second O-ring seal 40. The second O-ring seal 40 is arranged between the coaxial cable end 20 of the housing 12 and the insertion region 18 when seen in the axial direction and lies in a sealing position against an inner side of the housing 12, so that the second O-ring seal 40 provides axial sealing against the ingress of fluids, in particular water.

The first O-ring seal 38 is arranged and configured between the ring-shaped front face 19 of the housing 12 and the plug end 14 of the housing 12 in the insertion region 18 when seen in the axial direction in such a way that the first O-ring seal 38 projects into a ring-shaped region within the housing 12, in which a section of the mating housing is located when the mating coaxial plug connector is inserted into the coaxial plug connector. In this way, the first O-ring seal 38 lies in a sealing position in the radial direction against an inner side of the mating housing.

Thus, a region within the sealing sleeve 36 is completely sealed against the ingress of fluids, in particular water. Therefore when the housing 12 and the mating housing are plugged together, independently of the configuration of the housing and of the mating housing, possibly with breakthroughs in the radial direction, all metal parts of the coaxial plug connector, namely the external conductor element 26 and the internal conductor element 22, are effectively sealed against contact with fluids from the environment, in particular humidity, such that corrosion inside the coaxial plug connector is effectively prevented even in wet environments. The housing 12 or the mating housing need not be modified to achieve this sealing, but on the contrary may exhibit breakthroughs through which fluids, for example water, can penetrate into a space within the housing 12. However, this penetrating fluid remains trapped between the sealing sleeve 36, the inner side of the housing 12 and the two O-ring seals 38 and 40 and therefore cannot penetrate to the metal parts of the coaxial plug connector. In other words, abutting faces between the housing 12 and the mating housing and any breakthroughs in the housing 12, for example those resulting from snap-in mechanisms, are rendered impermeable within the housing 12.

The ring seal 34 creates additional sealing at the coaxial cable end 20 of the housing 12 against the ingress of fluids along the jacket of the coaxial cable 10.

At the coaxial cable end 20 of the housing 12 there is additionally provided a tube-shaped section or tube-shaped extension 42, which exhibits two opposing, resilient snap-in tongues 44 facing radially inward. These serve for the latching of a corrugated tube 46, which if necessary is pushed as a mechanical protection over the coaxial cable 10 outside the coaxial plug connector.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. Coaxial plug connector for a coaxial cable comprising a housing made of an electrically insulating material, which at a plug end is open for the plugging of a mating coaxial plug connector with a mating housing and exhibits an insertion region for the mating housing, into which the mating housing projects in an inserted state, and at a coaxial cable end exhibits an axial opening for implementing the coaxial cable, where in the housing there is arranged an internal conductor element for electric connection with an internal conductor of the coaxial cable and an external conductor element for electrical connection with an external conductor of the coaxial cable and where at the housing there is arranged and configured a snap-in mechanism in such a way that it fixes the external conductor element in the housing at least in the axial direction, characterized in that there is provided a sealing sleeve which surrounds the external conductor element in the circumferential direction completely and in the axial direction at least in one region, which extends from a part of the housing at the coaxial cable end of the housing that is enclosed on all sides in the radial direction to the insertion region for the mating housing at the plug end of the housing.

2. The coaxial plug connector of claim 1 including having the insertion region bounded in the direction of the coaxial cable end of the housing by a ring-shaped front face of the housing, where at the external circumference of the sealing sleeve there is arranged a first O-ring seal, which in the axial direction between the ring-shaped front face of the housing and the plug end of the housing in the insertion region is arranged and configured in such a way, that the first O-ring seal projects into a ring-shaped region within the housing, which is recessed in the housing for the insertion of a section of the mating housing.

3. The coaxial plug connector of claim 1, including a second O-ring seal arranged at the external circumference of the sealing sleeve, which in the axial direction between the coaxial cable end of the housing and the insertion region is arranged and configured in such a way that the second O-ring seal lies radially against the inner circumference of the housing.

4. The coaxial plug connector of claim 1 including a ring seal arranged in the radial direction at the coaxial cable end of the housing, lying against an inner side of the housing with an axial opening for the coaxial cable.

5. The coaxial plug connector of claim 4 wherein the inner diameter of the axial opening of ring seal is smaller than the outer diameter of the coaxial cable.

6. The coaxial plug connector of claim 4 including a crimping sleeve crimped on at a coaxial cable end of the external conductor element together with an external conductor of the coaxial cable.

7. The coaxial plug connector of claim 6 wherein the crimping sleeve is crimped at its coaxial cable end onto a plug end of the ring seal.

8. The coaxial plug connector of claim 1 including an axial extension arranged at the coaxial cable end of the housing with at least one resilient snap-in tongue facing radially inward.

9. The Coaxial plug connector of claim 8 wherein the axial extension is configured as one piece with the housing.

10. Coaxial plug connector according to claim 2 including a second O-ring seal arranged at the external circumference of the sealing sleeve, which in the axial direction between the coaxial cable end of the housing and the insertion region is arranged and configured in such a way that the second O-ring seal lies radially against the inner circumference of the housing.

11. Coaxial plug connector of claim 3 including a ring seal arranged in the radial direction at the coaxial cable end of the housing, lying against an inner side of the housing with an axial opening for the coaxial cable.

12. The coaxial plug connector of claim 3 including a crimping sleeve crimped on at a coaxial cable end of the external conductor element together with an external conductor of the coaxial cable.

13. The coaxial plug connector of claim 2 including an axial extension arranged at the coaxial cable end of the housing with at least one resilient snap-in tongue facing radially inward.

14. The coaxial plug connector of claim 4 including an axial extension arranged at the coaxial cable end of the housing with at least one resilient snap-in tongue facing radially inward.

15. The Coaxial plug connector of claim 13 wherein the axial extension is configured as one piece with the housing.

16. The Coaxial plug connector of claim 14 wherein the axial extension is configured as one piece with the housing.

* * * * *